US006056302A

United States Patent [19]

Smith

[11] Patent Number: 6,056,302

[45] Date of Patent: May 2, 2000

[54] SKATEBOARD TRUCK ASSEMBLY

[76] Inventor: Marc Smith, 298 Green Lea Pl., Thousand Oaks, Calif. 91361

[21] Appl. No.: 09/135,426

[22] Filed: Aug. 17, 1998

[51] Int. Cl.[7] ..... A63C 17/02; B62M 1/00

[52] U.S. Cl. ..... 280/87.042; 280/11.28

[58] Field of Search ..... 280/11.27, 11.28, 280/87.042, 11.19, 809, 811, 87.021, 87.041, 87.03

[56] References Cited

U.S. PATENT DOCUMENTS

| | | | |
|---|---|---|---|
| 2,027,254 | 1/1936 | Vogt | 280/11.28 |
| 4,109,925 | 8/1978 | Williams et al. | 280/11.28 |
| 4,152,001 | 5/1979 | Christianson | 280/11.28 |
| 4,180,278 | 12/1979 | Gotlieb | 280/87.042 |
| 4,185,847 | 1/1980 | Johnson | 280/87.042 |
| 4,214,768 | 7/1980 | Dominy et al. | 280/87.042 |
| 4,398,735 | 8/1983 | Evans et al. | 280/11.28 |
| 4,515,379 | 5/1985 | Pasques | 280/11.27 |
| 4,898,398 | 2/1990 | Cassel | 280/87.042 |
| 5,879,013 | 3/1999 | Shih | 280/11.28 |

*Primary Examiner*—F. Zeender
*Attorney, Agent, or Firm*—Larry F. Gitlin, Esq; Rapkin & Gitlin

[57] ABSTRACT

A skateboard truck assembly that includes a skateboard, a mounting plate, which is used to mount the truck assembly to the underside of the board, a mounting bracket to bridge the truck assembly to the mounting plate and an axle assembly, which includes axle rods, axle hubs and two wheels. The axle assembly is generally arcuate in shape and includes a lower surface with a more pronounced arcuate design and a central arched section. Each axle rod extends outwardly from the central arched section and slopes down to a terminus point adjacent to the inside portion of the wheel where the axle rod flares relative to the size of the axle hub to conform to the interior sidewall of the wheel and the underside of the flared axle rod coincides in substantial aligned relation with the corresponding wheel tread.

4 Claims, 2 Drawing Sheets

SKATEBOARD TRUCK ASSEMBLY

BACKGROUND OF THE INVENTION

1. Field of the Invention

The present invention relates generally to the area of skateboards and, more particularly, to a skateboard truck assembly that substantially improves the board's stability and balance and enables a rider to more safely control the action of the skateboard when it shifts from a grinding maneuver to the dismount off the grind surface.

2. Description of the Prior Art

Skateboard truck assemblies in the prior art typically include a mounting plate, which connects the truck assembly to the underside of the skateboard, and some type of bracket to bridge the axle assembly and wheels to the mounting plate. The two axle assemblies on a skateboard are mostly conventional in design and include the axles and the wheels mounted to the axles. As disclosed in U.S. Pat. No. 4,898,398 to Cassel; U.S. Pat. No. 4,398,735, to Evans, et al., and U.S. Pat. No. 4,214,768 to Dominy, et al., axles generally tend to be straight, not bent or curved, and narrow relative to the diameter of the wheels which are mounted to them. There is a space that exists between the point where the wheel is mounted to the axle and the wheel tread, possibly as much as 1½" or more. It is this area between where the axle and the wheel are joined and the wheel tread that has been the principal cause of some serious safety problems plaguing skateboard riders since the inception of the device and the sport's popularity.

The problem is specifically associated with the maneuver in the sport called grinding, which involves the "dumping" of a skateboard in motion onto a grind surface, such as a railing or the coping of a cement swimming pool, and then catching the grind surface along the underside of the axle and sliding or "grinding" along the grind surface until the maneuver is over and the rider and the board complete the dismount. The challenge for the rider is to ride the board along the grind surface for as long as possible moving the board laterally between the wheels in the process and then, while there is still sufficient speed, and in a controlled fashion, slide the board off the grind surface and complete the dismount off the grind surface to bring the skateboard and rider safely to the ground.

The problem confronting the rider in these situations is the abrupt contact that often occurs between the inside area of the wheel, which is that portion between where the axle joins the wheel and the wheel tread, and the grind surface during the grinding maneuvers and the dismount. What normally happens is that the grind surface will usually snag or get hung up on the inside edge of the wheel as the board moves laterally between the wheels causing the board to jerk suddenly and consequently the rider to lose his balance. Too often this results in a fall and possible serious injury to the rider. The faster the skateboard is going during the grind, the more forcefully the rider could be catapulted off the board when the grind surface catches the inside of the wheel.

The solution to this problem is to provide an axle that includes the structural component with the means to assist the rider in maintaining better balance and that functions to improve the board's stability and predictability through the various grinding maneuvers and the dismount. In this regard, the axle component of the present invention has a gradual arch shape allowing for the grind surface to move in and away from the central portion of the axle in a more controllable, predictable and generally safer manner than has ever been possible with the prior art devices.

Furthermore, the axle at both ends conforms to the shape of the interior sidewall of the wheel and has an underside component with a surface that coincides substantially with the surface of the wheel tread. These closely adjacent surfaces enable the board, riding along its axles in a grinding maneuver, to easily, and in a controlled and predictable manner, smoothly slide off the grind surface during the dismount without the normal risk of an abrupt snag or a sudden jerky motion that could catapult the rider to the ground and cause him serious injury.

SUMMARY OF THE INVENTION

The present invention provides a skateboard truck assembly that includes a skateboard, a mounting plate, which is used to mount the truck assembly to the underside of the board, a mounting bracket to bridge the truck assembly to the mounting plate and an axle assembly, which includes a main axle and two wheels. The main axle is generally arcuate in shape and includes a lower surface with a more pronounced arcuate design and a central arched portion. The underside of the main axle extending outwardly from the central arched portion slopes down to the respective terminus points adjacent to the inside section of the wheels. At these junctures, the axle hubs narrow to enable the wheels to be mounted thereon, the end portions of the main axle conform to the shape of the interior sidewalls of the wheels and the underside of the flared main axle coincides in substantially aligned relation with the corresponding wheel treads.

The present invention also provides an axle with the means to cover a substantial portion of the wheel hub to protect that area against the intrusion of dirt, small pebbles and grit into the wheel bearings situated within the hub.

Accordingly, an object of the present invention is to provide a skateboard truck assembly that enables a skateboard rider to engage in safe grinding maneuvers and a controlled and more predictable dismount off the grind surface.

Another object of the present invention is to provide a skateboard truck assembly with a concavely arcuate surface to facilitate more controllable and balanced grinding maneuvers.

Another object of the present invention is to provide a skateboard truck assembly which includes an axle assembly that enables the rider with greater balance and stability to maneuver the skateboard off the grind surface to complete a safe dismount.

Still another object of the present invention is to provide a skateboard truck assembly that includes an axle assembly which precludes the skateboard wheel from snagging or hanging up on a portion of the grind surface and abruptly catapulting the board and the rider off the grind surface to the ground.

Still another object of the present invention is to provide a skateboard truck assembly with an axle having end sections that substantially cover the wheel hubs to protect against the intrusion of grit, pebbles and dirt into the wheel bearings.

Still another object of the present invention is to provide a skateboard truck assembly that is easily and efficiently manufactured.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 1:
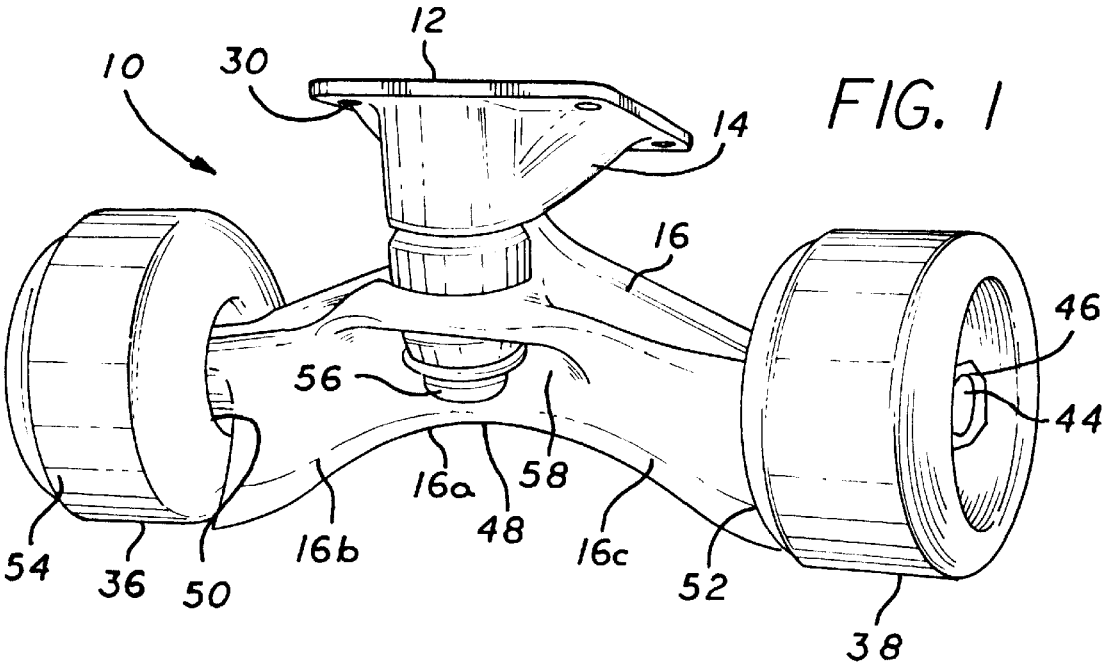
FIG. 1 is a perspective view of the skateboard assembly of the present invention.
Figure 3:
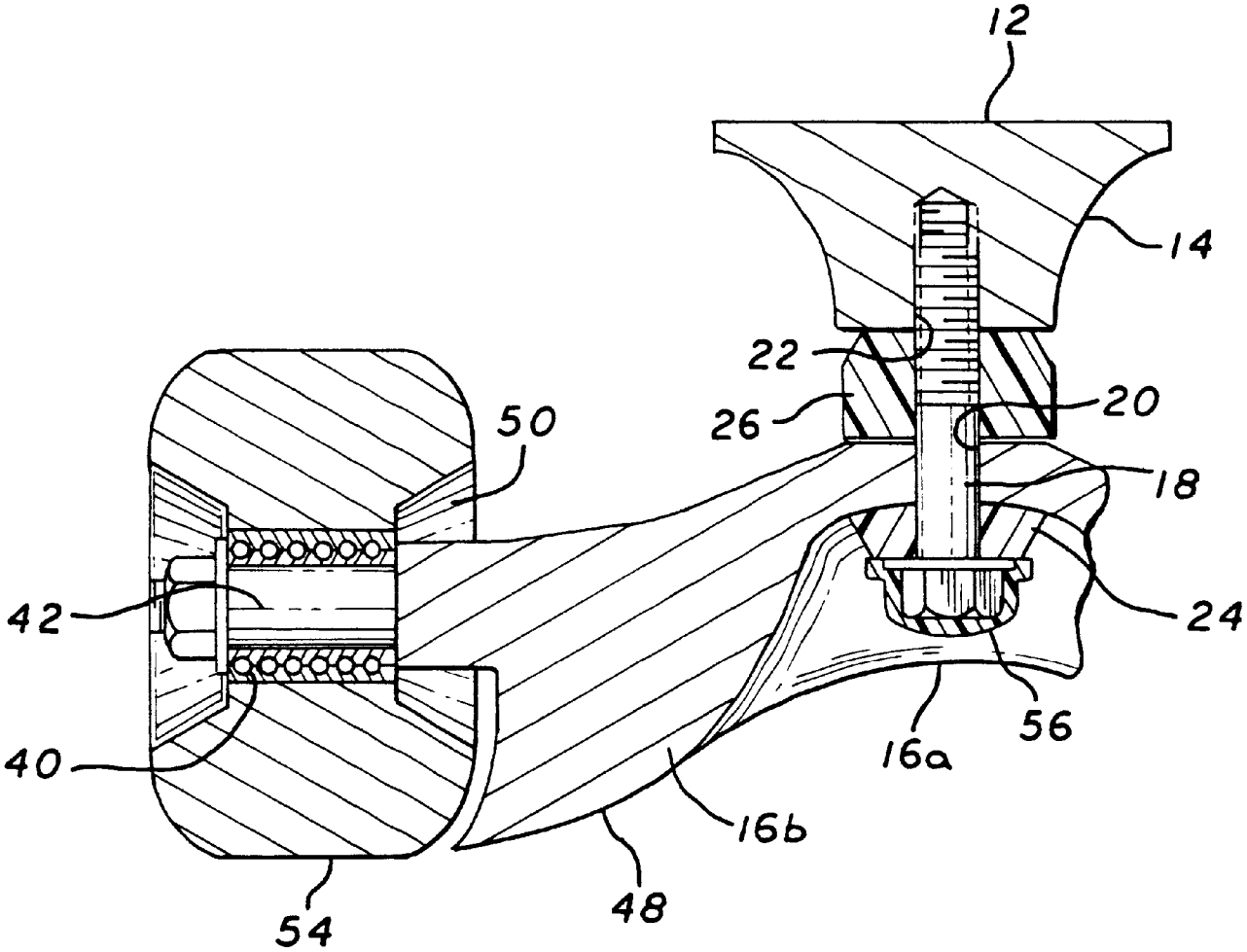
FIG. 3 is a fragmentary cross-sectional view of the skateboard truck assembly of the present invention.

Referring more particularly to the drawings, FIG. 1 is a perspective view of the present invention depicting a skateboard truck assembly 10, which includes a mounting plate 12, a mounting bracket 14, and an axle assembly 16. A kingpin 18, also known as a tension bolt, is inserted through apertures 20 and 22 to connect the axle assembly 16 to the mounting bracket 14 and the mounting plate 12. Bushings 24, 26 are also provided. Generally, the mounting plate 12 and mounting bracket 14 are unitary structures, though they can constitute separate components under the desired circumstances. The truck assembly 10, particularly the axle assembly 16, can be fabricated of any light weight metal alloy, including, for example, aluminum and titanium. High impact polymers or materials made of carbon fiber can also be used to fabricate the device.

Figure 2:
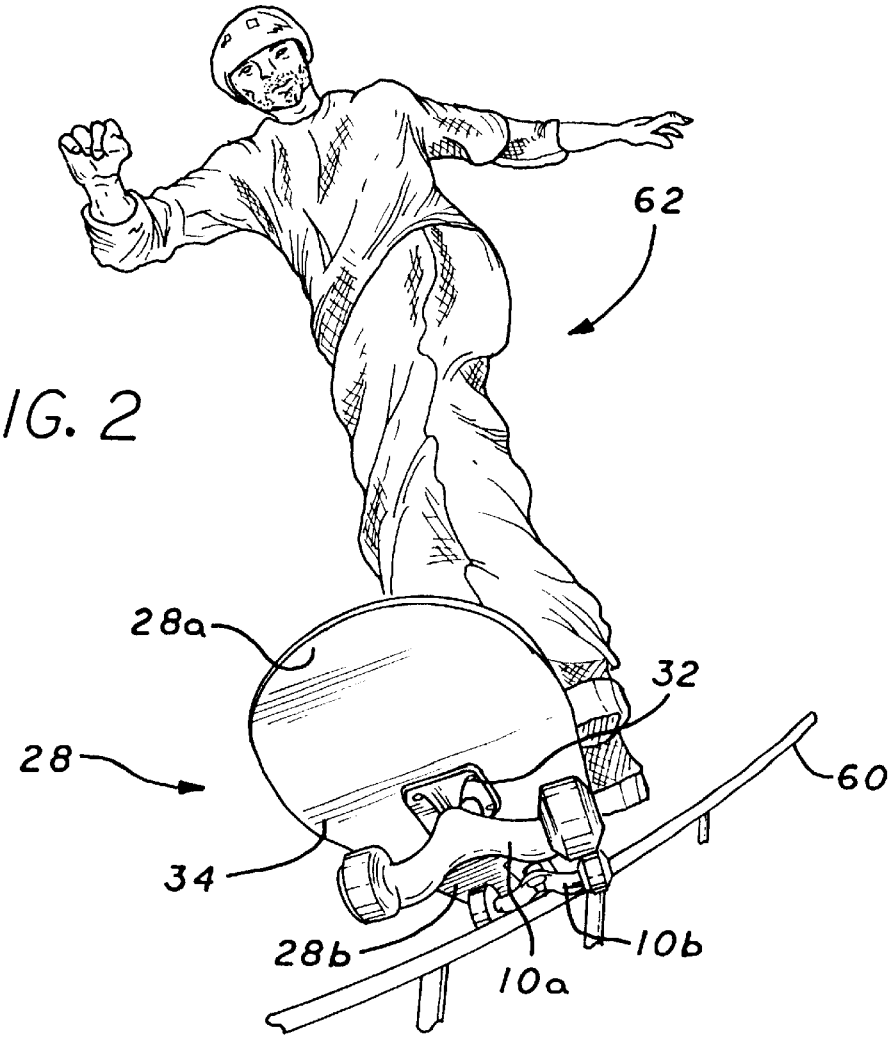
FIG. 2 is a perspective view of two identical skateboard truck assemblies of the present invention shown attached to a skateboard with a rider maneuvering the board along a grind surface.

The mounting plate 12 is provided to secure the truck assembly 10 to the skateboard 28. Apertures 30 in the mounting plate 12 are provided to receive screws or bolts 32 to connect the mounting plate 12 to the underside 34 of the skateboard 28. Typically, skateboard 28 will include two truck assemblies, as shown in FIG. 2, one assembly 10*a* mounted to the underside 34 of the skateboard 28 in the front section 28*a* of the board 28 and a second truck assembly 10*b* mounted to the underside 34 of the skateboard 28 in the skateboard's back section 28*b*.

Axle assembly 16, which is normally a unitary structure, includes a central arched portion 16*a* and a main axle comprising axle rods 16*b* and 16*c*, which extend away in opposite directions from central arched portion 16*a*. Wheels 36, 38, which include wheel bearings 40, are mounted on axle hubs 42, 44 of axle rods 16*b*, 16*c*, respectively. Wheels 36, 38 are secured on the axle hubs 42, 44, respectively, using a nut 46 or any other suitable means for this purpose. The present invention can accommodate wheels of different sizes.

Underside 48 of axle assembly 16 is concavely arcuate in shape. Axle rods 16*b*, 16*c* are substantially wider in structure than the axle hubs 42, 44 and conform to the shape of the interior sidewalls 35, 37 of wheels 36, 38. Axle rods 16*b*, 16*c* also enable substantial coverage of the area within the wheel hubs 50, 52 and to protect the wheel hubs 50, 52 from intrusion of foreign matter, such as dirt and small pebbles, into the wheel bearings 40. This intrusion, if allowed, would eventually interfere with the smooth and free rotation of the wheels and, thus, the safe and most effective use of the skateboard. Underside 48 of the axle assembly 16 substantially coincides with the surface of the wheel tread 54 on each of the wheels 36, 38.

Head 56 of kingpin 18 is located within a recessed area 58 of the central arched portion 16*a*. The position of the kingpin 18 in this manner prevents the grind surface 60 from hanging up or snagging on the pin and causing the skateboard to suddenly stop or abruptly change direction and possibly catapulting the rider 62 off the board to the ground.

The skateboard maneuver known as grinding involves the manipulation of the skateboard onto a grind surface, usually a long piece of pipe, a street curb, pool coping, a bench or any other surface narrow enough to accommodate the space in between the skateboard's wheels. In a typical application of the present invention, the rider 62 "dumps" the skateboard 28 onto the grind surface 60 and initiates the grinding maneuver by forcing the axle assembly 16, particularly the area between the wheels 36, 38, to slide or "grind" along the grind surface. The maneuver includes compelling the board to slide laterally between the wheels as well as to move the board in a forward direction as the axles literally scrape along the grind surface. Employing the device of the present invention, the rider will experience less wobble and enhanced stability during the grind maneuver. The present invention also improves the rider's ability to control the board and provides the board a greater degree of predictability during the ride. A much safer dismount off the grind surface is also more likely.

Beginner skateboarders can learn the sport under safer conditions and novices and more experienced riders can become proficient at a quicker pace than is possible with any of the prior art devices. Even difficult grinding maneuvers become easier to perform with the use of the present invention. The confidence of the rider is substantially enhanced and both beginners and more experienced riders are more apt to improve their skills as a result.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

What is claimed is:

1. A skateboard and a skateboard truck assembly having the capability to perform grinding maneuvers relative to a grind surface comprising, in combination, a mounting plate for mounting said assembly to the underside of said skateboard, a mounting bracket attached to said mounting plate, said mounting bracket including an aperture therethrough for receiving a tension bolt for mounting said assembly to said skateboard, and an axle assembly with opposing ends and at least two wheels, each of said wheels being attached to a corresponding said opposing end of said axle assembly and having an outer radial tread surface, an interior sidewall and a hub including bearings therein, said axle assembly having an aperture therethrough for receiving said tension bolt to connect said axle assembly to said mounting bracket, and a concavely arcuate lower section with a concavely arcuate bottom surface, said lower section including a central arched portion and a first arm member and a second arm member extending outwardly in opposed directions from said central arched portion towards said wheels, said first arm member and said second arm member having respective first and second end portions flaring to generally conform to the shape of said interior sidewalls and the approximate radius of said wheels and positioned adjacent said wheel hubs whereby said bottom end portions each have a lowermost surface in substantially aligned relationship with the outer radial tread surface of each of said wheels, respectively, for improving board stability through a grinding maneuver and the controlled transition of the rider and said skateboard upon the dismount from the grind surface.

2. The skateboard truck assembly of claim 1 wherein each of said first and second end portions adjacent to their corresponding said wheel hubs substantially covers said wheel hubs for protecting said bearings inside said wheel hubs from the intrusion of foreign matter that would impede the free rotation of said wheels.

3. The skateboard truck assembly of claim 1 wherein the tension bolt is recessed within the central arched portion to preclude the grind surface from snagging on said bolt and destabilizing the ride.

4. A skateboard truck assembly, including a mounting assembly, with the capability of performing grinding maneuvers relative to a grind surface, comprising in combination a mounting base for mounting said assembly to the underside of said skateboard and an axle assembly attached to said mounting base, said axle assembly with opposing ends including at least two wheels attached at said opposing ends, each of said wheels having an outer radial tread surface, an interior sidewall and a hub, said axle assembly having an aperture therethrough for receiving a tension bolt to connect said axle assembly to said mounting base and a concavely arcuate lower section with a concavely arcuate bottom surface, said lower section including a central arched portion and a first arm member and a second arm member extending outwardly from said central arched portion in opposed directions towards said wheels, said first arm member and said second arm member having respective first and second end portions flaring to generally conform to the shape of said interior sidewalls and the approximate radius of said wheels and positioned adjacent said wheels whereby said end portions each have a lowermost surface in substantially aligned relationship with the outer radial tread surface of each of said wheels, respectively, for improving board stability through a grinding maneuver and the controlled transition of the rider and said skateboard upon the dismount from the grind surface.

* * * * *

UNITED STATES PATENT AND TRADEMARK OFFICE

CERTIFICATE OF CORRECTION

PATENT NO : 6,056,302
DATED : May 2, 2000
INVENTOR(S) : Marc Smith

It is certified that error appears in the above-identified patent and that said Letters Patent are hereby corrected as shown below:

Column 5, line 9
A skateboard <u>and a skateboard</u> truck assembly, including ...

Signed and Sealed this

Third Day of April, 2001

*Attest:*

Nicholas P. Godici

NICHOLAS P. GODICI

*Attesting Officer*

*Acting Director of the United States Patent and Trademark Office*